US010752852B2

(12) United States Patent
Doykhen et al.

(10) Patent No.: US 10,752,852 B2
(45) Date of Patent: Aug. 25, 2020

(54) FUEL ADDITIVE

(71) Applicant: INNOTECH LTD., Moscow (RU)

(72) Inventors: Dmitry Yurievich Doykhen, Zhukovskiy (RU); Dmitriy Georgievich Petrov, Byisk (RU); Vadim Davydovich Shterenlikht, Moscow (RU)

(73) Assignee: INNOTECH LTD., Moscow (RU)

( * ) Notice: Subject to any disclaimer, the term of this patent is extended or adjusted under 35 U.S.C. 154(b) by 0 days.

(21) Appl. No.: 15/580,669

(22) PCT Filed: Aug. 25, 2016

(86) PCT No.: PCT/RU2016/000575
§ 371 (c)(1),
(2) Date: Dec. 7, 2017

(87) PCT Pub. No.: WO2017/034443
PCT Pub. Date: Mar. 2, 2017

(65) Prior Publication Data

US 2018/0298296 A1 Oct. 18, 2018

(30) Foreign Application Priority Data

Aug. 26, 2015 (RU) ..... 2015136187

(51) Int. Cl.

| | |
|---|---|
| ***C10L 1/14*** | (2006.01) |
| ***C10L 1/16*** | (2006.01) |
| ***C10L 1/18*** | (2006.01) |
| *C10L 1/188* | (2006.01) |
| *C10L 1/19* | (2006.01) |
| *C10L 1/182* | (2006.01) |

(52) U.S. Cl.
CPC ..... *C10L 1/18* (2013.01); *C10L 1/14* (2013.01); *C10L 1/1616* (2013.01); *C10L 1/1824* (2013.01); *C10L 1/1881* (2013.01); *C10L 1/19* (2013.01); *C10L 2200/0423* (2013.01); *C10L 2200/0446* (2013.01); *C10L 2230/22* (2013.01); *C10L 2270/023* (2013.01); *C10L 2270/026* (2013.01); *C10L 2270/04* (2013.01)

(58) Field of Classification Search
CPC .... C10L 1/026; C10L 1/18; C10L 1/14; C10L 1/1616; C10L 1/1824; C10L 1/1881; C10L 1/19; C10L 2230/22; C10L 2270/023; C10L 2270/04; C10L 2270/026; C10L 2200/0423; C10L 2200/0446; Y02E 50/13
See application file for complete search history.

(56) References Cited

U.S. PATENT DOCUMENTS

| | | | | |
|---|---|---|---|---|
| 5,876,467 | A | 3/1999 | Hohn et al. | |
| 2003/0061761 | A1* | 4/2003 | Nanninga | C10L 1/026 44/400 |
| 2013/0091759 | A1* | 4/2013 | Peterson | C07C 29/60 44/307 |

FOREIGN PATENT DOCUMENTS

| | | | | |
|---|---|---|---|---|
| EP | 0839174 | B2 | 1/1999 | |
| RU | 2254358 | C1 | 6/2005 | |
| WO | WO-02079353 | A1 * | 10/2002 | C10L 10/02 |

* cited by examiner

*Primary Examiner* — Latosha Hines

(57) ABSTRACT

A hydrocarbon fuel additive being a solution of the active complex in an organic solvent is provided, wherein the active complex consists of: chiral ester C4-C9 and monocarboxylic acid C1-C6. The achievable technical result is the decrease in the hydrocarbon fuel consumption in gasoline and diesel internal combustion engines, boiler units from 4.7 to 9.9%, and, accordingly, the increase in the efficiency of these devices, as well as the extension of the range of tools to reduce the hydrocarbon fuel consumption and improve the efficiency of internal combustion engines and boiler units.

13 Claims, No Drawings

FUEL ADDITIVE

FIELD OF THE INVENTION

The present invention relates to hydrocarbon fuel additives.

BACKGROUND OF THE INVENTION

From the prior art according to the present invention there are many hydrocarbon fuels additives. However practice demonstrates that the effectiveness of most additives has not been proven yet.

The task that underlies the present invention and the achievable technical result is to reduce the hydrocarbon fuel consumption in gasoline and diesel internal combustion engines, boiler units, and, accordingly, increase the efficiency of these devices, as well as to extend an arsenal of tools to reduce the hydrocarbon fuel consumption and improve the efficiency of internal combustion engines and boiler units.

SUMMARY OF THE INVENTION

The problem is solved by using the hydrocarbon fuel additive that is a solution of the active complex in an organic solvent, where the active complex consists of: chiral ester C4-C9, monocarboxylic acid C1-C6.

This additive in hydrocarbon fuels ensures a reduction in fuel consumption ranging from 4.7 to 9.9%.

In this case the molar ratio of chiral ester to monocarboxylic acid in the active complex is preferably from 60:40 to 90:10.

In this case, the additive maximum efficiency is achieved.

The amount of the active complex in the additive is preferably from 0.5 to 12% mass.

This concentration range ensures the precise dosage of the additive and, accordingly, the precise dosage of the active complex in the fuel, and it excludes the impact of solvent on the active complex as for the fuel properties.

It is advisable, that the organic solvent provides the dissolution of the active complex with the true solution formation and provides the dissolution of the additive in hydrocarbon fuel with the true solution formation, as even a partial formation of an additive colloidal solution in the fuel or a partial additive settling-out reduces the additive effectiveness.

It is also preferably to add the additive in the hydrocarbon fuel so that to ensure the concentration of the active complex in hydrocarbon fuel from $1*10^{-6}$ to $25.0*10^{-6}$ gram-moles per liter.

In this case, the maximum additive efficiency is achieved.

The problem is also solved by using the hydrocarbon fuel additive active complex comprising chiral ester C4-C9 and monocarboxylic acid C1-C6.

This active complex in the hydrocarbon fuel provides the decrease in the fuel consumption from 4.7 to 9.9%.

In this case the molar ratio of chiral ester to monocarboxylic acid in the active complex is preferably from 60:40 to 90:10.

In this case, the additive maximum efficiency is achieved.

The problem is also solved by using the hydrocarbon fuel comprising: chiral ester C4-C9 and monocarboxylic acid C1-C6.

These components in hydrocarbon fuels ensure the reduction in fuel consumption from 4.7 to 9.9%.

In this case the molar ratio of chiral ester to monocarboxylic acid is preferably from 60:40 to 90:10.

In this case the additive maximum efficiency is achieved.

It is also preferably that the total concentration of the chiral ester and the monocarboxylic acid in the hydrocarbon fuel is from $1*10^{-6}$ to $25.0*10^{-6}$ gram-moles per liter.

In this case the additive maximum efficiency is achieved.

DETAILED DESCRIPTION OF THE INVENTION

According to the present invention, the additive active complex to the hydrocarbon fuel consists of two components:

chiral ester (hereinafter, CE) with the number of carbon atoms from 4 to 9 (C4-C9);

monocarboxylic acid with number of carbon atoms from 1 to 6 (C1-C6).

As shown in the experimental data, when chiral ester with the total number of carbon atoms more than 9 (10 or more) is used in the additive, the additive becomes unstable. The fuel additive may form a colloidal mixture (the fuel clouding in case the additive is added) or the additive settling-out. This negative effect for chiral esters C10 and more is particularly evident at low temperatures (minus 5° C. and below).

Thus, as the result of the carried-out experiments it was determined that the CE usage with the number of carbon atoms more than 9 (10 or more) is impossible.

The minimum number of carbon atoms in CE is four.

The possibility of achieving the claimed technical result, namely, the reduced hydrocarbon fuel consumption, is confirmed by the experimental data.

The experiments were carried out on the basis of the SAK-P-670 brake stand with the UMP 4216.10 gasoline engine (the experiments 1-8) and with the D-145T diesel engine (the experiments 9-16), as well as the KSV-1,76 hot-water boiler (the experiments 17-24). In the process of bench testing on one engine, at first the fuel consumption without the additive was measured, and then—the fuel consumption with the additive. The engine behavior (the crankshaft torque moment and rotation frequency) for both fuels was maintained unchanged, the nominal one for this engine. During the experiments on the boiler unit at first, the fuel consumption without the additive was measured, then the fuel consumption with the additive. The operating parameters of the boiler unit (the heating capacity, the fuel oil pressure and temperature before the injector, the pressure of the primary and the secondary air) for both fuels were maintained unchanged. The measurement accuracy of the fuel consumption is ±1%.

The experiments 1-8 were carried out for automobile gasoline.

Experiment 1

In the experiment 1, the additive of the following composition was used:

chiral ester R-2-hydroxypropionate (C4);

formic acid (C1).

The molar ratio of CE to the acid ranged from 50:50 to 95:5.

The AI92 gasoline was used as the hydrocarbon fuel. The additive was added to the fuel in the amount from $0.8*10^{-6}$ to $30*10^{-6}$ gram-moles per liter.

The results of the experiment are shown in the Table 1.

TABLE 1

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | −0.4 | 0.6 | 0.7 | 0.3 |
| 1.0 | 0.2 | 4.8 | 6.1 | −0.2 |
| 25.0 | 0.4 | 5.2 | 5.3 | −0.4 |
| 30.0 | 0.4 | 0.4 | 0.3 | 0.4 |

As follows from the experimental data, the positive effect of fuel saving in the range from 4.8% to 6.1% is observed when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 2

In the experiment 2, the additive of the following composition was used:

chiral ester S-2-methyl-3-methylbutylpropanoate (C9);

formic acid (C1).

The molar ratio of CE to the acid ranged from 50:50 to 95:5.

The gasoline AI92 was used as the hydrocarbon fuel. The additive was added to the fuel in the amount from $0.8*10^{-6}$ to $30*10^{-6}$ gram-moles per liter.

The results of the experiment are shown in the Table 2.

TABLE 2

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.5 | 0.3 | 0.5 | 0.5 |
| 1.0 | −0.1 | 5.7 | 6.2 | 0.4 |
| 25.0 | 0 | 5.2 | 6.3 | −0.1 |
| 30.0 | −0.4 | 0.2 | −0.3 | −0.2 |

As follows from the experimental data, the positive effect of fuel saving in the range from 5.7 to 6.3% is observed, when the molar ratio of CE to the acid is in the range from 60:40 to 90:10, and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 3

In the experiment 3 the additive of the following composition was used:

chiral ester isobutyl-R-lactate (C7);

propionic acid (C3).

The molar ratio of CE to the acid ranged from 50:50 to 95:5.

The gasoline AI92 was used as the hydrocarbon fuel. The additive was added to the fuel in the amount from $0.8*10^{-6}$ to $30*10^{-6}$ gram-moles per liter.

The results of the experiment are shown in the Table 3.

TABLE 3

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.2 | 0.2 | 0.5 | 0.4 |
| 1.0 | −0.2 | 5.9 | 6.0 | 0.2 |
| 25.0 | 0.1 | 6.2 | 7.3 | 0.1 |
| 30.0 | 0.3 | 0.3 | 0 | −0.2 |

As follows from the experimental data, the positive effect of fuel saving in the range from 5.9 to 7.3% is observed when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 4

In the experiment 4 the additive of the following composition was used:

chiral ester R-2-hydroxypropyl formate (C4);

hexanoic acid (C6).

The molar ratio of CE to the acid ranged from 50:50 to 95:5.

The gasoline AI92 was used as the hydrocarbon fuel. The additive was added to the fuel in the amount from $0.8*10^{-6}$ to $30*10^{-6}$ gram-moles per liter.

The results of the experiment are given in the Table 4.

TABLE 4

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.1 | 0.6 | 0.6 | −0.4 |
| 1.0 | 0.1 | 4.7 | 5.0 | −0.2 |
| 25.0 | −0.4 | 4.7 | 5.3 | 0.2 |
| 30.0 | 0.5 | 0.4 | 0.5 | −0.4 |

As follows from the experimental data, the positive effect of fuel saving in the range from 4.7 to 5.3% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 5

In the experiment 5 the additive of the following composition was used:

chiral ester S-2-methyl-3-methylbutylpropanoate (C9);

hexanoic acid (C6).

The molar ratio of CE to the acid ranged from 50:50 to 95:5

The gasoline AI92 was used as the hydrocarbon fuel. The additive was added to the fuel in the amount from $0.8*10^{-6}$ to $30*10^{-6}$ gram-moles per liter.

The results of the experiment are shown in the Table 5.

TABLE 5

| The fuel rate reduction, in % | | | | |
|---|---|---|---|---|
| The concentration of the active complex in fuel, mcg * mol/l | The molar ratio of CE to acid in the active complex | | | |
| | 50:50 | 60:40 | 90:10 | 95:5 |
| 0.8 | −0.1 | 0.5 | 0.4 | 0.4 |
| 1.0 | −0.1 | 4.9 | 5.6 | 0.3 |
| 25.0 | −0.4 | 4.8 | 5.3 | 0.4 |
| 30.0 | 0.2 | 0.5 | −0.4 | −0.3 |

As follows from the experimental data, the positive effect of fuel saving in the range from 4.8 to 5.6% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error and the positive effect is not observed.

Experiment 6

In the experiment 6 the additive of the following composition was used:

chiral ester R-2-hydroxypropyl formate (C4);

heptanoic acid (C7).

The molar ratio of the CE to the acid ranged from 50:50 to 95:5.

The gasoline AI92 was used as the hydrocarbon fuel. The additive was added to the fuel in the amount from $0.8*10^{-6}$ to $30*10^{-6}$ gram-moles per liter.

The results of the experiment are shown in the Table 6.

TABLE 6

| The fuel rate reduction, in % | | | | |
|---|---|---|---|---|
| The concentration of the active complex in fuel, mcg * mol/l | The molar ratio of CE to acid in the active complex | | | |
| | 50:50 | 60:40 | 90:10 | 95:5 |
| 0.8 | −0.2 | 0.6 | 0.3 | 0.4 |
| 1.0 | −0.2 | 0.8 | 0.5 | 0.3 |
| 25.0 | 0.3 | 0.7 | 0.3 | 0.4 |
| 30.0 | 0.2 | 0.5 | −0.4 | −0.3 |

As follows from the experimental data in the whole range of the active complex concentrations in the fuel and the molar ratios of CE to the acid, the additive impact on fuel consumption is in the range of the measurement error.

Experiment 7

In the experiment 7 the additive of the following composition was used:

chiral ester S-2-methyl-3-methylbutylpropanoate (C9);

heptanoic acid (C7).

The molar ratio of CE to the acid ranged from 50:50 to 95:5.

The gasoline AI92 was used as the hydrocarbon fuel. The additive was added to the fuel in the amount from $0.8*10^{-6}$ to $30*10^{-6}$ gram-moles per liter.

The results of the experiment are shown in the Table 7.

TABLE 7

| The fuel rate reduction, in % | | | | |
|---|---|---|---|---|
| The concentration of the active complex in fuel, mcg * mol/l | The molar ratio of CE to acid in the active complex | | | |
| | 50:50 | 60:40 | 90:10 | 95:5 |
| 0.8 | 0.4 | 0.5 | 0.2 | 0.2 |
| 1.0 | 0.3 | 0.4 | 0.6 | 0.2 |
| 25.0 | 0.2 | 0.6 | 0.3 | 0.5 |
| 30.0 | 0.2 | 0.4 | −0.1 | −0.4 |

As follows from the experimental data in the whole range of the active complex concentrations in the fuel and the molar ratios of CE to the acid, the additive impact on fuel consumption is in the range of the measurement error.

The experiment was carried-out with the additive, where the chiral ester was replaced by the achiral ester (AE).

Experiment 8

In the experiment 8 the additive of the following composition was used:

achiral ester n-amylacetate (C7);

propionic acid (C3).

The molar ratio of AE to the acid ranged from 50:50 to 95:5.

The gasoline AI92 was used as the hydrocarbon fuel. The additive was added to the fuel in the amount from $0.8*10^{-6}$ to $30*10^{-6}$ gram-moles per liter.

The results of the experiment are given in the Table 8.

TABLE 8

| The fuel rate reduction, in % | | | | |
|---|---|---|---|---|
| The concentration of the active complex in fuel, mcg * mol/l | The molar ratio of CE to acid in the active complex | | | |
| | 50:50 | 60:40 | 90:10 | 95:5 |
| 0.8 | −0.3 | 0.4 | −0.2 | 0.1 |
| 1.0 | −0.3 | −0.5 | 0.5 | −0.2 |
| 25.0 | 0.2 | 0.6 | 0.2 | 0.4 |
| 30.0 | −0.2 | 0.1 | −0.2 | 0.3 |

As follows from the experimental data in the whole range of the active complex concentrations in the fuel and the molar ratios of AE to the acid, the additive impact on fuel consumption is in the range of the measurement error.

As follows from the above-mentioned data, the active complex according to the present invention has a positive effect on the gasoline consumption. The fuel economy is ranged from 4.7 to 7.3%.

The experiments 9-16 were carried-out for diesel.

Experiment 9

In the experiment 9 the additive of the following composition was used:

chiral ester R-2-hydroxypropyl formate (C4);

formic acid (C1).

The molar ratio of CE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are shown in the Table 9.

TABLE 9

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | 0.4 | 0.3 | 0.2 | 0.1 |
| 1.0 | −0.4 | 5.1 | 6.2 | 0.2 |
| 25.0 | 0.3 | 5.2 | 6.3 | −0.2 |
| 28.0 | −0.4 | −0.4 | 0.5 | 0.5 |

As follows from the experimental data, the positive effect of the fuel saving with the range from 5.1 to 6.3% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 10

In the experiment 10 the additive of the following composition was used:

chiral ester S-2-methyl-3-methylbutylpropanoate (C9);

formic acid (C1).

The molar ratio of CE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are given in table 10.

TABLE 10

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | 0.6 | 0.5 | 0.4 | −0.7 |
| 1.0 | −0.3 | 6.5 | 6.7 | 0.3 |
| 25.0 | −0.7 | 5.9 | 7.7 | −0.1 |
| 28.0 | −0.4 | 0.3 | −0.4 | 0.4 |

As follows from the experimental data, the positive effect of fuel saving in the range from 5.9 to 7.7% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 11

In the experiment 11 the additive of the following composition was used:

chiral ester isobutyl-R-lactate (C7);

propionic acid (C3).

The molar ratio of CE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are shown in the Table 11.

TABLE 11

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | −0.5 | 0.6 | 0.3 | 0.4 |
| 1.0 | 0.2 | 6.9 | 6.0 | −0.1 |
| 25.0 | 0.3 | 7.0 | 8.3 | 0.5 |
| 28.0 | 0.3 | −0.3 | 0.6 | 0.8 |

As follows from the experimental data, the positive effect of fuel saving in the range from 6.0 to 8.3% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 12

In the experiment 12 the additive of the following composition was used:

chiral ester R-2-hydroxypropyl formate (C4);

hexanoic acid (C6).

The molar ratio of CE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are shown in the Table 12.

TABLE 12

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | −0.2 | 0.7 | 0.7 | −0.3 |
| 1.0 | −0.2 | 4.7 | 6.9 | −0.2 |
| 25.0 | −0.4 | 5.6 | 5.4 | 0.4 |
| 28.0 | 0.2 | 0.8 | 0.4 | 0.6 |

As follows from the experimental data, the positive effect of the fuel saving in the range from 4.7 to 6.9% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 13

In the experiment 13 the additive of the following composition was used:

chiral ester S-2-methyl-3-methylbutylpropanoate (C9);

hexanoic acid (C6).

The molar ratio of CE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are shown in the Table 13.

TABLE 13

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | 0.2 | 0.2 | −0.7 | 0.4 |
| 1.0 | −0.8 | 4.9 | 6.6 | 0.6 |
| 25.0 | −0.5 | 5.8 | 7.3 | 0.8 |
| 28.0 | 0.4 | 0.9 | −0.1 | −0.1 |

As follows from the experimental data, the positive effect of the fuel saving in the range from 4.9 to 7.3% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error and the positive effect is not observed.

Experiment 14

In the experiment 14 the additive of the following composition was used:

chiral ester R-2-hydroxypropyl formate (C4);

heptanoic acid (C7).

The molar ratio of CE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are shown in the Table 14.

TABLE 14

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | 0.2 | 0.6 | −0.3 | 0.4 |
| 1.0 | −0.1 | 0.8 | 0.5 | −0.3 |
| 25.0 | −0.3 | 0.9 | 0.7 | 0.4 |
| 28.0 | 0.8 | 0.9 | 0.8 | −0.3 |

As follows from the experimental data in the whole range of the active complex concentrations in the fuel and the molar ratios of CE to the acid, the additive impact on the fuel consumption is in the range of the measurement error.

Experiment 15

In experiment 15 was used additive of the following composition:

chiral ester S-2-methyl-3-methylbutylpropanoate (C9);

heptanoic acid (C7).

The molar ratio of CE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are shown in the Table 15.

TABLE 15

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | −0.4 | 0.5 | −0.2 | −0.2 |
| 1.0 | 0.3 | 0.3 | −0.5 | −0.4 |
| 25.0 | 0.1 | 0.8 | 0.3 | 0.5 |
| 28.0 | 0.2 | 0.6 | 0.8 | −0.3 |

As follows from the experimental data in the whole range of the active complex concentrations in the fuel and the molar ratios of CE to the acid, the additive impact on the fuel consumption is in the range of the measurement error.

The experiment was also carried-out with the additive, where the chiral ester was replaced by the achiral ester (AE).

Experiment 16

In the experiment 16 the additive of the following composition was used:

achiral ester n-amylacetate (C7);

propionic acid (C3)

The molar ratio of AE to the acid ranged from 50:50 to 95:5.

The diesel fuel, L-02-62 brand, was used as the hydrocarbon fuel. The additive was added to the fuel in the amount from $0.8*10^{-6}$ to $28*10^{-6}$ gram-moles per liter.

The results of the experiment are shown in the Table 16.

TABLE 16

| The fuel rate reduction, in % | | | | |
|---|---|---|---|---|
| The concentration of the active complex in fuel, mcg * mol/l | The molar ratio of CE to acid in the active complex 55:45 | 60:40 | 90:10 | 95:5 |
| 0.8 | −0.3 | 0.4 | −0.2 | 0.1 |
| 1.0 | −0.3 | −0.5 | 0.5 | −0.2 |
| 25.0 | 0.2 | 0.6 | 0.2 | 0.4 |
| 28.0 | −0.2 | 0.1 | −0.2 | 0.3 |

As follows from the experimental data in the whole range of the active complex concentrations in the fuel and the molar ratios of AE to the acid, the additive impact on the fuel consumption is in the range of the measurement error.

As can be seen from the above-mentioned data, the active complex, according to the present invention, has a positive effect on the diesel fuel consumption. The fuel economy is ranged from 4.7 to 8.3%.

In case of making of the active complex with the composition that is beyond the scope of the present invention or where the achiral ester is used any impact on fuel savings is not observed.

The experiments 17-24 were carried-out for fuel oil.

Experiment 17

In the experiment 17 the additive of the following composition was used:

chiral ester R-2-hydroxypropyl formiate (C4);

formic acid (C1).

The molar ratio of CE to the acid ranged from 50:50 to 95:5.

The fuel oil, M-100 grade, was used as the hydrocarbon fuel. The additive was added to fuel in the amount from $0.8*10^{-6}$ to $30*10^{-6}$ gram-moles per liter.

The results of the experiment are shown in the Table 17.

TABLE 17

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | −0.2 | 0.7 | 0.5 | 0.3 |
| 1.0 | −0.1 | 8.8 | 7.1 | 0.4 |
| 25.0 | 0.4 | 8.2 | 9.3 | 0.3 |
| 30.0 | 0.5 | 0.5 | 0.5 | 0.4 |

As follows from the experimental data, the positive effect of the fuel saving in the range from 7.1 to 9.3% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits the fuel rate reduction is within the measurement error and the positive effect is not observed.

Experiment 18

In the experiment 18 the additive of the following composition was used:

chiral ester S-2-methyl-3-methylbutylpropanoate (C9);

formic acid (C1).

The molar ratio of CE to the acid ranged from 50:50 to 95:5.

The fuel oil, M-100 grade, was used as the hydrocarbon fuel. The additive was added to the fuel in the amount from $0.8*10^{-6}$ to $30*10^{-6}$ gram-moles per liter.

The results of the experiment are shown in the Table 18.

TABLE 18

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.6 | 0.4 | 0.3 | 0.5 |
| 1.0 | 0.6 | 9.6 | 7.2 | 1.2 |
| 25.0 | 0.5 | 8.8 | 7.4 | 0.9 |
| 30.0 | 0.9 | 0.9 | 1.1 | 0.7 |

As follows from the experimental data, the positive effect of the fuel saving in the range from 7.2 to 9.6% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 19

In the experiment 19 the additive of the following composition was used:

chiral ester isobutyl-R-lactate (C7);

propionic acid (C3).

The molar ratio of CE to the acid ranged from 50:50 to 95:5.

The fuel oil, M-100 grade, was used as the hydrocarbon fuel. The additive was added to the fuel in the amount of $0.8*10^{-6}$ to $30*10^{-6}$ gram-moles per liter.

The results of the experiment are shown in table 19.

TABLE 19

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.2 | 0.6 | 0.7 | 0.5 |
| 1.0 | −0.2 | 9.9 | 8.1 | 0.9 |
| 25.0 | 0.6 | 7.2 | 8.0 | 0.2 |
| 30.0 | 0.4 | 0.8 | 0.6 | −0.2 |

As follows from the experimental data, the positive effect of the fuel saving in the range from 7.2 to 9.9% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 20

In the experiment 20 was used additive of the following composition:

chiral ester R-2-hydroxypropyl formate (C4);

hexanoic acid (C6).

The molar ratio of CE to the acid ranged from 50:50 to 95:5.

The fuel oil, M-100 grade, was used as the hydrocarbon fuel M-100. The additive was added to the fuel in the amount of $0.8*10^{-6}$ to $30*10^{-6}$ gram-moles per liter.

The results of the experiment are shown in the Table 20.

TABLE 20

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.5 | 0.7 | 0.4 | 1.1 |
| 1.0 | 0.5 | 8.7 | 7.0 | −0.9 |
| 25.0 | −0.1 | 8.7 | 8.3 | 0.6 |
| 30.0 | 0.4 | 0.6 | 1.0 | −0.8 |

As follows from the experimental data, the positive effect of the fuel saving in the range from 7.0 to 8.7% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits, the fuel rate reduction is within the measurement error, and the positive effect is not observed.

Experiment 21

In the experiment 21 was used additive of the following composition:

chiral ester S-2-methyl-3-methylbutylpropanoate (C9);

hexanoic acid (C6).

The molar ratio of CE to the acid ranged from 50:50 to 95:5.

The fuel oil, M-100 grade, was used as the hydrocarbon fuel M-100. The additive was added to the fuel in the amount of $0.8*10^{-6}$ to $30*10^{-6}$ gram-moles per liter.

The results of the experiment are shown in the Table 21.

TABLE 21

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.9 | 0.1 | 0.6 | 0.4 |
| 1.0 | 0.8 | 9.9 | 8.6 | 0.9 |
| 25.0 | 0.4 | 6.8 | 7.3 | 0.4 |
| 30.0 | 0.8 | 1.2 | −0.4 | 1.3 |

As follows from the experimental data, the positive effect of the fuel saving in the range from 6.8 to 9.9% is observed, when the molar ratio of CE to the acid is in the range from 60:40 to 90:10 and the active complex concentration in the fuel is from $1.0*10^{-6}$ to $25*10^{-6}$ gram-moles per liter.

When the active complex concentrations in the fuel and the molar ratios of CE to the acid are below and above the specified limits the fuel rate reduction is within the measurement error and the positive effect is not observed.

Experiment 22

In the experiment 22 the additive of the following composition was used:

chiral ester R-2-hydroxypropyl formate (C4);

heptanoic acid (C7).

The molar ratio of CE to the acid ranged from 50:50 to 95:5.

The fuel oil, M-100 grade, was used as the hydrocarbon fuel M-100. The additive was added to the fuel in the amount of $0.8*10^{-6}$ to $30*10^{-6}$ gram-moles per liter.

The results of the experiment are shown in the Table 22.

TABLE 22

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | −0.8 | 0.6 | 0.1 | 0.5 |
| 1.0 | −0.2 | −0.8 | 0.7 | 1.3 |
| 25.0 | 0.9 | 1.2 | −0.3 | 0.4 |
| 30.0 | 0.2 | 0.5 | −0.4 | −1.3 |

As follows from the experimental data in the whole range of the active complex concentrations in the fuel and the molar ratios of CE to the acid, the additive impact on the fuel consumption is in the range of the measurement error.

Experiment 23

In the experiment 23 the additive of the following composition was used:

chiral ester S-2-methyl-3-methylbutylpropanoate (C9);

heptanoic acid (C7).

The molar ratio of CE to the acid ranged from 50:50 to 95:5.

The fuel oil, M-100 grade, was used as the hydrocarbon fuel M-100. The additive was added to the fuel in the amount of $0.8*10^{-6}$ to $30*10^{-6}$ gram-moles per liter.

The results of the experiment are shown in the Table 23.

TABLE 23

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.3 | 0.3 | 0.7 | 0.2 |
| 1.0 | 0.4 | 0.4 | 0.7 | 0.8 |
| 25.0 | −0.2 | 1.6 | 0.9 | 0.5 |
| 30.0 | 0.6 | 0.4 | −0.1 | −0.4 |

As follows from the experimental data in the whole range of the active complex concentrations in the fuel and the molar ratios of CE to the acid, the additive impact on the fuel consumption is in the range of the measurement error.

Also an experiment was conducted with the additive, where the chiral ester was replaced by the achiral ether (AE).

Experiment 24

In the experiment 24 the additive of the following composition was used:

achiral ester n-amylacetate (C7);

propionic acid (C3).

The molar ratio of AE to the acid ranged from 50:50 to 95:5.

The fuel oil, M-100 grade, was used as the hydrocarbon fuel M-100. The additive was added to the fuel in the amount of $0.8*10^{-6}$ to $30*10^{-6}$ gram-moles per liter.

The results of the experiment are shown in the Table 24.

TABLE 24

| The fuel rate reduction, in % | | | | |
|---|---|---|---|---|
| The concentration of the active complex in fuel, mcg * mol/l | The molar ratio of CE to acid in the active complex 50:50 | 60:40 | 90:10 | 95:5 |
| 0.8 | 0.4 | 0.4 | −0.1 | −0.1 |
| 1.0 | −0.3 | 0.4 | 0.4 | −0.2 |
| 25.0 | 0.3 | −0.5 | −0.2 | 0.5 |
| 30.0 | 0.1 | 0.2 | −0.3 | −0.2 |

As follows from the experimental data in the whole range of the active complex concentrations in the fuel and the molar ratios of AE to the acid, the additive impact on the fuel consumption is in the range of the measurement error.

As can be seen from the above-mentioned data, the active complex, according to the present invention, has a positive effect on the fuel oil consumption. Fuel economy is ranged from 7.0 to 9.9%.

In the case the active complex manufacturing, with the composition that is beyond the scope of the present invention, or where the achiral ester is used, any impact on the fuel saving is not observed.

The additional experiments were carried-out with individual CE, AE and the monocarboxylic acid.

Chiral ester isobutyl-R-lactate (C7) was used as CE.

Achiral ester n-amylacetate (C7) was used as AE;

Propionic acid (C3) was used as the monocarboxylic acid.

The experimental results for gasoline are shown in the Table 25.

TABLE 25

| The fuel rate reduction, in % | | | |
|---|---|---|---|
| The concentration of the substance in fuel, mcg * mol/l | CE | AE | Acid |
| 0.8 | 0.3 | 0.5 | −0.1 |
| 1.0 | 0.2 | −0.4 | 0.2 |
| 25.0 | −0.1 | 0.5 | 0.1 |
| 30.0 | 0.1 | −0.3 | 0.1 |

The experimental results for the diesel fuel are given in the Table 26.

TABLE 26

| The fuel rate reduction, in % | | | |
|---|---|---|---|
| The concentration of the substance in fuel, mcg * mol/l | CE | AE | Acid |
| 0.8 | 0.6 | 0.6 | −0.7 |
| 1.0 | −0.6 | 0.5 | 0.4 |
| 25.0 | 0.8 | −0.5 | −0.2 |
| 30.0 | 0.4 | −0.4 | 0.1 |

The results of the experiments for the residual fuel oil are given in the Table 27.

TABLE 27

| The fuel rate reduction, in % | | | |
|---|---|---|---|
| The concentration of the substance in fuel, mcg * mol/l | CE | AE | Acid |
| 0.8 | −0.8 | 0.5 | −0.8 |
| 1.0 | −0.5 | 0.6 | 0.7 |
| 25.0 | 0.3 | −0.5 | −0.8 |
| 30.0 | −0.1 | 0.2 | −0.7 |

As follows from the obtained results, the individual compounds composing the active complex, as well as the individual AE, do not insure the reduction in fuel consumption.

To facilitate the fuel use and dosing it is desirable to use a solvent.

Organic compounds are used as a solvent. For example, aliphatic hydrocarbons C5-C20, aliphatic alcohol C2-C8, C3-C60 ester or their arbitrary mixture.

The basic requirements to the solvent are as follows:

the active compound should be dissolved in the solvent with the true solution formation;

the additive (solvent plus active complex) should be dissolved in the fuel with the true solution formation;

the solvent should not impede the fuel oxidation reaction in an engine.

The active complex weight content in the additive should be between 0.5 to 12%. The concentration range shall be chosen on the basis of practical reasons. In case the concentration is less than 0.5%, the solvent starts to exert an independent influence on properties of the fuel, where the additive is added. In case the concentration is above 12%, the problems with dosing accuracy arise.

According to the present invention, the full-scale tests were carried out with the additive, and the results of the tests are shown in the Tables 1-24.

The fuel economy ranging from 4.7 to 9.9% was recorded for different engine behaviors.

As can be seen from the above-mentioned data, according to the present invention the active complex has a positive effect on the consumption of various hydrocarbon fuels. It is obvious, that this additive ensures the fuel saving for all types of hydrocarbon fuel, particularly for gasoline, diesel fuel, bunker oil, fuel oil, furnace fuel, etc.

The invention claimed is:

1. A hydrocarbon fuel additive, being a solution of the active complex in an organic solvent, characterized in that the active complex consists of:

a chiral ester with the number of carbon atoms from 4 to 9 and a monocarboxylic acid with the number of carbon atoms from 1 to 6, wherein the chiral ester is selected from the group consisting of R-2-hydroxypropionate, S-2-methyl-3-methylbutylpropanoate, isobutyl-R-lactate, R-2-hydroxypropyl formate, and n-amylacetate, and the monocarboxylic acid is selected from the group consisting of a formic acid, a propionic acid, a hexanoic acid, and a heptanoic acid.

2. The additive according to claim 1, characterized in that the molar ratio of chiral ester to monocarboxylic acid in the active complex ranges from 60:40 to 90:10.

3. The additive according to claim 1 or 2, characterized in that the amount of the active complex in the additive ranges from 0.5 to 12% mass.

4. The additive according to claim 1 or 2, characterized in that the organic solvent insures the dissolution of the active complex with a true solution formation and insures the additive dissolution in the hydrocarbon fuel with the true solution formation.

5. The additive according to claim 1 or 2, characterized in that it is added to the hydrocarbon fuel, so that to ensure the active complex concentration in the hydrocarbon fuel ranging from $1*10^{-6}$ to $25.0*10^{-6}$ gram-moles per liter.

6. The additive according to claim 3, characterized in that it is added to the hydrocarbon fuel so that to ensure the active complex concentration in the hydrocarbon fuel ranging from $1*10^{-6}$ to $25.0*10^{-6}$ gram-moles per liter.

7. The additive according to claim 4, characterized in that it is added to the hydrocarbon fuel, so that to ensure the active complex concentration in the hydrocarbon fuel ranging from $1*10^{-6}$ to $25.0*10^{-6}$ gram-moles per liter.

8. An active complex of an additive to the hydrocarbon fuel, consisting of:

a chiral ester with the number of carbon atoms from 4 to 9 and a monocarboxylic acid with the number of carbon atoms from 1 to 6 wherein the chiral ester is selected from the group consisting of R-2-hydroxypropionate, S-2-methyl-3-methylbutylpropanoate, isobutyl-R-lactate, R-2-hydroxypropyl formate, and n-amylacetate, and the monocarboxylic acid is selected from the group consisting of a formic acid, a propionic acid, a hexanoic acid, and a heptanoic acid.

9. The active complex according to the claim 8, characterized in that the molar ratio of chiral ester to monocarboxylic acid is ranged from 60:40 to 90:10.

10. A hydrocarbon fuel, comprising:

a chiral ester with the number of carbon atoms from 4 to 9 and a monocarboxylic acid with the number of carbon atoms from 1 to 6; wherein the molar ratio of chiral ester to monocarboxylic acid ranges from 60:40 to 90:10, the chiral ester is selected from the group consisting of R-2-hydroxypropionate, S-2-methyl-3-methylbutylpropanoate, isobutyl-R-lactate, R-2-hydroxypropyl formate, and n-amylacetate, and the monocarboxylic acid is selected from the group consisting of a formic acid, a propionic acid, a hexanoic acid, and a heptanoic acid.

11. The hydrocarbon fuel according to claim 10, characterized in that the total concentration of chiral ester and monocarboxylic acid in the hydrocarbon fuel ranges between $1*10^{-6}$ to $25.0*10^{-6}$ gram-moles per liter.

12. The hydrocarbon fuel according to claim 10, characterized in that the hydrocarbon fuel is gasoline, diesel fuel, bunker fuel, heating oil, heating fuel.

13. The hydrocarbon fuel according to claim 11, characterized in that the hydrocarbon fuel is gasoline, diesel fuel, bunker fuel, heating oil, heating fuel.

* * * * *